US005701768A

United States Patent [19]

Khalsa

[11] Patent Number: 5,701,768

[45] Date of Patent: Dec. 30, 1997

[54] BOX CAR LOCK

[76] Inventor: Ek Ong Kar S. Khalsa, Rte. 1, Box 219, Espanola, N. Mex. 87532

[21] Appl. No.: 728,664

[22] Filed: Oct. 10, 1996

Related U.S. Application Data

[63] Continuation of Ser. No. 383,245, Feb. 3, 1995, abandoned.

[51] Int. Cl.[6] ..... E05B 13/00

[52] U.S. Cl. ..... 70/14; 70/56; 70/203; 70/212

[58] Field of Search ..... 70/54–56, 177, 70/180, 202, 203, 211, 212, 14, 19

[56] References Cited

U.S. PATENT DOCUMENTS

| | | | |
|---|---|---|---|
| 3,550,409 | 12/1970 | Pariser | 70/203 |
| 4,041,738 | 8/1977 | Vann | 70/212 |
| 4,372,136 | 2/1983 | Mickelson | 70/14 |
| 4,640,109 | 2/1987 | Schaublin et al. | 70/211 X |
| 4,683,728 | 8/1987 | Hailey | 70/14 |
| 4,696,172 | 9/1987 | Farrow | 70/238 |
| 5,113,674 | 5/1992 | Li Causi | 70/212 X |
| 5,145,222 | 9/1992 | Meyer | 292/258 |
| 5,165,263 | 11/1992 | Perron et al. | 70/177 |
| 5,284,036 | 2/1994 | Rosenbaum | 70/14 |
| 5,372,018 | 12/1994 | Smith | 70/56 X |
| 5,388,435 | 2/1995 | Bailey | 70/202 X |

FOREIGN PATENT DOCUMENTS

| | | | |
|---|---|---|---|
| 909717 | 5/1946 | France | 70/212 |
| 2106058 | 4/1983 | United Kingdom | 70/226 |

*Primary Examiner*—Lloyd A. Gall
*Attorney, Agent, or Firm*—August E. Roehrig, Jr.

[57] ABSTRACT

A removably securable locking device especially suitable for use with the loading door of a railroad freight car whereby the rotatable door handle which latches the door in a closed position is secured against unauthorized movement by a two-piece locking device wherein a handle securing portion of an insertion piece encircles a part of the door handle, and then telescopes into a receiving piece which engages a portion of the door gear box such that upon securing the two pieces of the locking device in telescoped engagement, the door handle is locked against movement until the two pieces are moved out from each other a distance sufficient to release the door handle from engagement.

5 Claims, 4 Drawing Sheets

BOX CAR LOCK

This is a continuation of application Ser. No. 08/383,245 filed on Feb. 3, 1995, now abandoned.

BACKGROUND OF THE INVENTION

This invention relates in general to locking devices and, in particular, to a locking device especially suitable for use in securing the loading door of a railroad freight car. More specifically, but without restriction to the particular use which is shown and described, this invention relates to a locking device which may be removably secured to the sliding door of a railroad car for maintaining the door in a closed position.

As is known to those in the railroad industry, the access or loading doors of railroad freight cars, through which the contents are loaded and removed, are carried by the freight car so that the door will slide parallel to the sides of the car permitting an unobstructed access for loading and unloading. The sliding doors are latched in a closed position by rotation of an opening handle operating through a gear box secured to the door of the freight car. Rotational movement of the handle, through operation of a gear train, releases a latching mechanism permitting the freight car door to be slid out from a closed position for loading or unloading.

Because freight cars are generally unattended and frequently are stored in and move through unpopulated areas, pilferage of the contents can occur if the loading doors are not locked against unauthorized entry. It is, therefore, desirable that a locking device be provided which will be rugged enough to withstand the working environment associated with freight cars, and the loading and unloading thereof.

In addition, after freight cars have been unloaded, the loading doors are frequently left open, there being no necessity for locking them closed. Accordingly, another desirable feature for such a locking device would be the ability to removably secure the device to the freight car so that it could be moved from car to car as necessary.

SUMMARY OF THE INVENTION

It is, therefore, an object of this invention to secure the loading doors of railroad freight cars in a closed position against unauthorized entry.

Another object of this invention is to fix the rotatable handle of a freight car opening device, the operation of which permits the loading door to be opened, against movement thereby preventing opening of the loading door.

A further object of this invention is to removably secure the locking device to the door of a railroad freight car so that the lock may be moved from car to car as desired.

These and other objects are attained in accordance with the present invention wherein there is a provided a removably securable locking device especially suitable for use with the loading door of a railroad freight car whereby the rotatable door handle which latches the door in a closed position is secured against unauthorized movement by a two-piece locking device wherein a handle securing portion of an insertion piece encircles a part of the door handle, and then telescopes into a receiving piece which engages a portion of the door gear box such that upon securing the two pieces of the locking device in telescoped engagement, the door handle is locked against movement until the two pieces are moved out from each other a distance sufficient to release the door handle from engagement.

DESCRIPTION OF THE DRAWINGS

Further objects of the invention, together with additional features contributing thereto and advantages accruing therefrom, will be apparent from the following description of a preferred embodiment of the invention which is shown in the accompanying drawings with like reference numerals indicating corresponding parts throughout, wherein.

DESCRIPTION OF A PREFERRED EMBODIMENT

Figure 1:
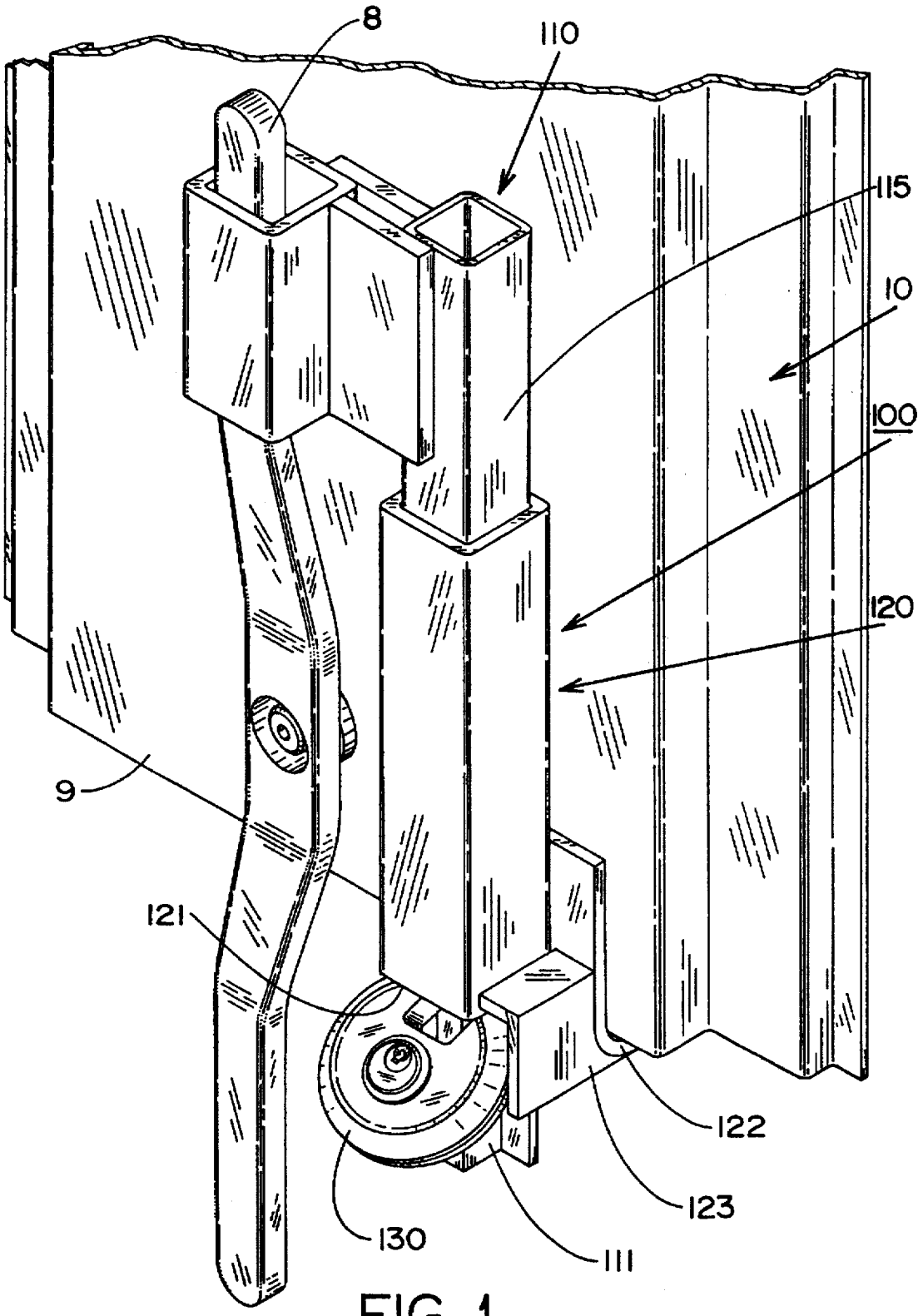
FIG. 1 is a perspective view of the locking device positioned on a portion of a railroad car loading door and engaging the opening handle thereof to prevent rotational movement of the handle.
Figure 2:
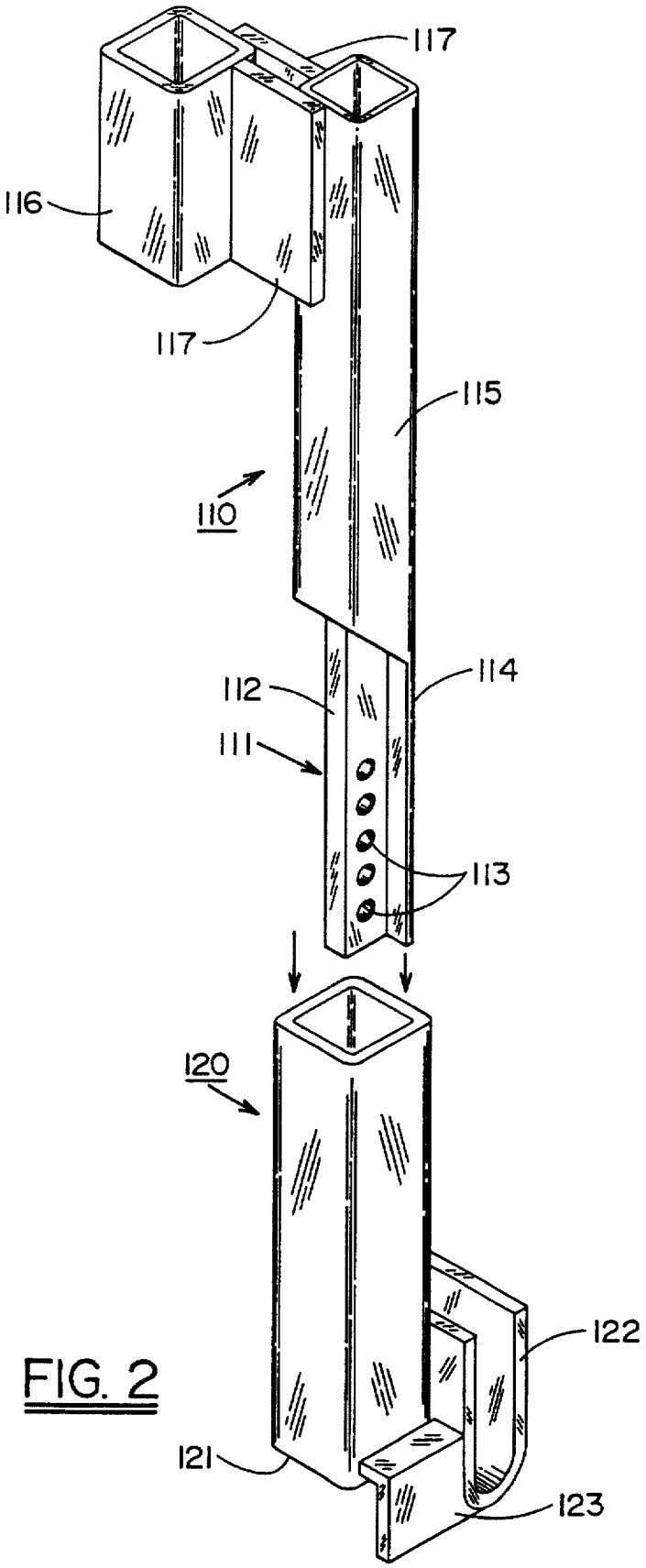
FIG. 2 is an exploded perspective view of the locking device shown in FIG. 1 to better illustrate the two portions thereof and the manner in which the pieces are telescoped together to perform the securing function.
Figure 4:
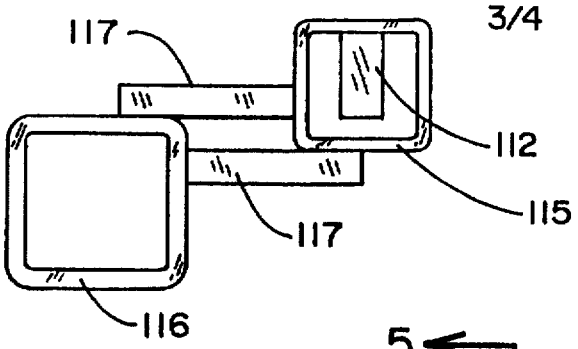
FIG. 4 is a top elevational view of the locking device illustrated in FIG. 3 taken along the lines 4—4.
Figure 3:
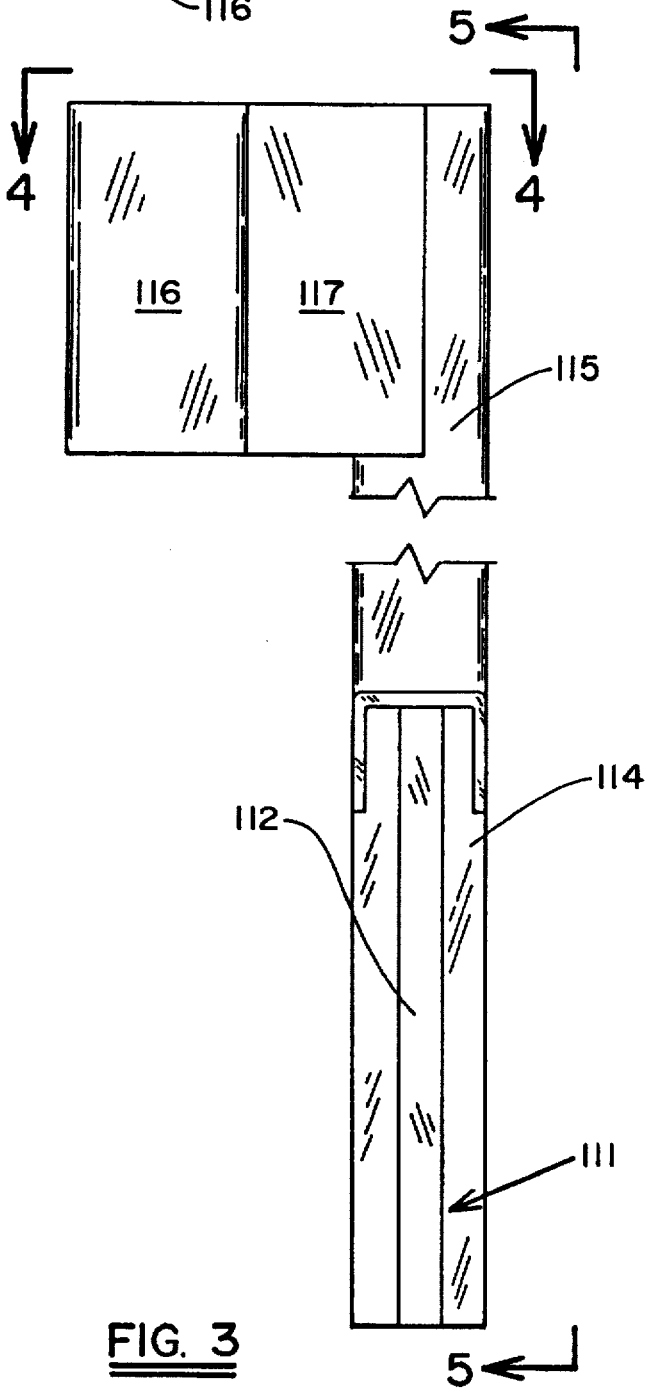
FIG. 3 is a frontal elevational view of the insertion member handle engaging portion of the locking device.
Figure 5:
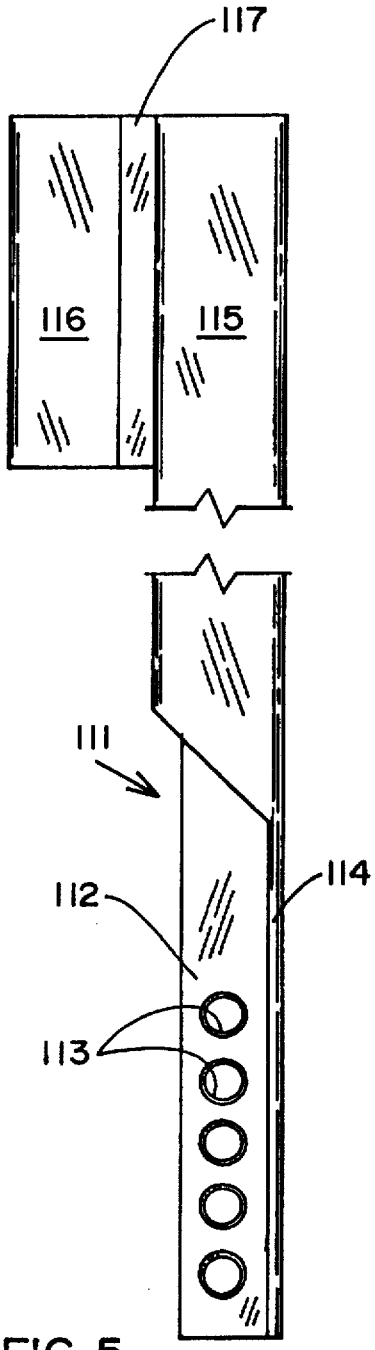
FIG. 5 is a profile elevational view of the portion of the locking device illustrated in FIG. 3 taken along the lines 5—5.
Figure 7:
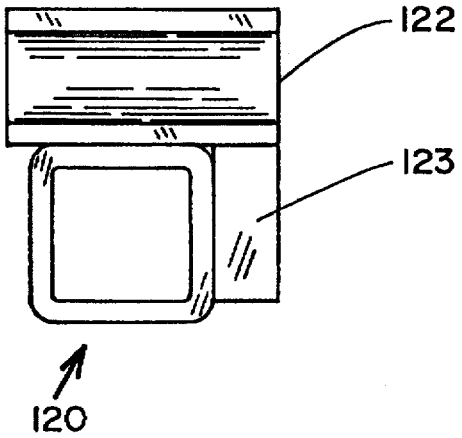
FIG. 7 is a top elevational view of the receiving member illustrated in FIG. 6 taken along the lines 7—7.
Figure 6:
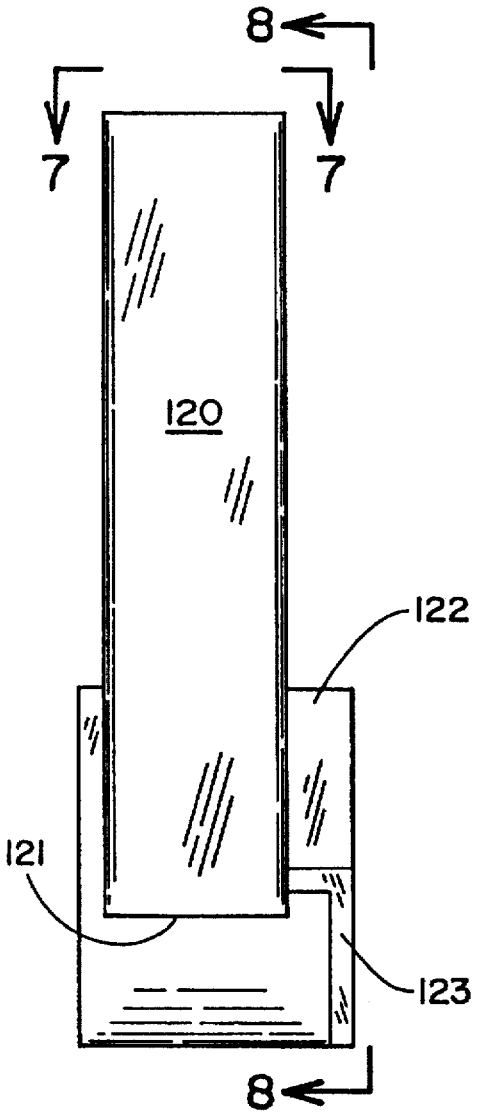
FIG. 6 is a front elevational view of the receiving member of the locking device to better illustrate the features thereof.
Figure 8:
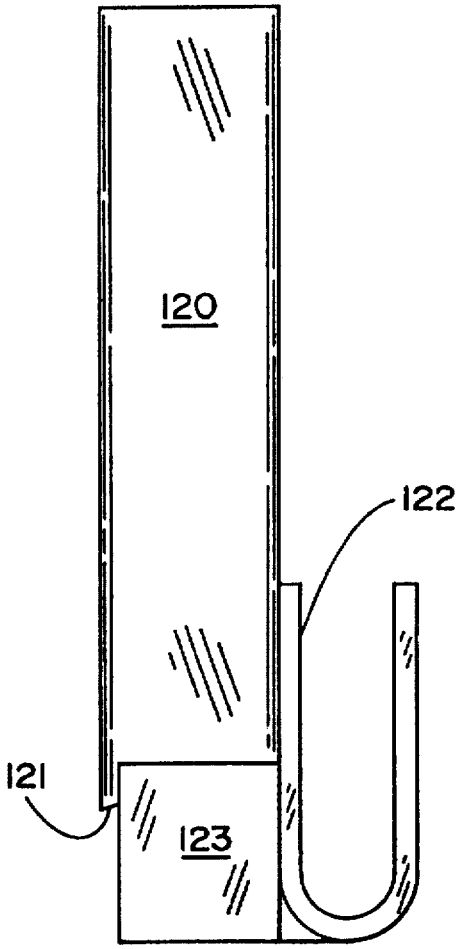
FIG. 8 is a side profile view of the receiving member of the locking device illustrated in FIG. 6 taken along the lines 8—8.

Referring now to FIG. 1, there is shown the locking device 100 positioned in engagement with the gear box portion 9 of a freight car door 10 securing the opening handle 8 against rotational movement. The locking device 100 includes an insertion member 110, illustrated in detail in FIGS. 3–5, and a receiving member 120 illustrated in detail in FIGS. 6–8. These two members are illustrated in an exploded view in FIG. 2, to better illustrate the manner in which the two parts telescope together to prevent rotational movement of the door handle 8 and to secure the locking device 100 to the freight car door 10.

Referring first to the insertion member 110 of the locking device, there is a lock engageable portion 111 having a generally T-shaped cross section, with the leg portion 112 of the T having a series of holes 113 formed therein through which the hasp of a padlock may be passed for securing the locking device in position when assembled in the manner shown in FIG. 1. The top bar portion 114 of the T extends into and is welded to a square tube 115 as best shown in FIGS. 2–5.

A handle securing portion 116 of the insertion member 110 is formed from square tube of a size for receiving handle 8 of the freight car door latching mechanism. The handle securing portion 116 is fixed to the tube member 115 as by welding a pair of flat steel plates 117 between the tube 115 and the square tube handle securing portion 116.

The receiving member 120, best shown in FIGS. 2 and 6–8, is formed of a square steel tube of a size sufficient to receive the lock engageable portion 111 of the insertion member 110 in a telescoping manner. The relative lengths of the insertion member 110 and receiving member 120 are such that the lock engageable portion 111 will extend outwardly from the bottom of the tube 121 when the handle securing portion 116 of the insertion member 110 is engaged upon the handle 8 of a box car door and the receiving member 120 is positioned against the gear box portion 9 of the door 10 with a U-shaped securing plate 122, fixed to the receiving member 120 as by welding, engaging the gear box 9. An L-shaped guard plate 123 is welded to the receiving member 120 and U-shaped securing plate 122 to extend downwardly beneath the lowermost opening 121 in the receiving member 120 to inhibit sawing or cutting of the hasp of a padlock used in securing the two portions of the locking device together when immobilizing the movement of a box door car handle, or removing the lock by severing the leg portion 112, especially at the point where a hole 113 is located.

In use, the insertion member 110 of the locking mechanism has the handle securing portion 116 placed about the upper end of the rotatable handle 8 of the box car door latching mechanism, as best shown in FIG. 1, and the receiving member 120 of the locking device is then inserted upwardly to receive the lock engageable portion 111 so that the portion 111 extends outwardly through the open bottom 121 of the receiving member 120. The receiving member 120 is telescoped onto the insertion member 110 until the U-shaped securing plate 122 engages a portion of the gear box 9 of the latching mechanism.

As heretofore explained, the relative lengths of the two portions 110 and 120 are such that the lock engageable portion 111 of the insertion member 110 extends outwardly from the open bottom 121 of the receiving member 120. A padlock 130, preferably of a security type having a minimum exposure of the hasp portion, is then placed through the uppermost accessible hole in the lock engageable portion 111 thereby locking these two portions together. The guard plate 123 is thereby positioned to inhibit the use of a hack saw or bolt cutter from severing the hasp of the padlock 130 or the leg portion 112.

While the invention has been described with reference to a preferred embodiment, it will be understood by those skilled in the art that various changes may be made and equivalents may be substituted for elements thereof without departing from the invention. For example, the unit could be reversed wherein the rotatable handle engaging portion 116 could engage the lower portion of the handle 8, and the receiving portion 120 could be placed against the top of the box car gear box 9. In addition, many other modifications such as the use of non-square tubing may be made to adapt a particular situation or material to the teachings of the invention without departing from the essential scope thereof. Therefore, it is intended that the invention not be limited to the particular embodiment disclosed in the specification and shown in the drawings as the best mode presently known by the invention for carrying out this invention, but that the invention will include all embodiments falling within the scope of the appended claims.

I claim:

1. A removably securable locking device, mountable on a door to be secured against opening without any permanent attachment thereto, for preventing the rotation of a rotatable handle which is operable in a circular path of movement for opening the door comprising:

an insertion member extending a first length and mountable on a door to be secured against opening without any fixed attachment thereto when in operative engagement to secure the door, said insertion member having a retaining portion at a first end thereof for engaging a portion of a rotatable handle operable in a circular path of movement to open the door which is to be secured to prevent rotation of the handle in a circular path of movement, said insertion member further including an insertion portion extending parallel to and spaced from said retaining portion, said insertion member being unattached to the door upon which it is mountable and further including a lock receiving portion at a second end thereof, said lock receiving portion having at least one opening therein for receiving therethrough the hasp of a lock;

a receiving member extending a second length which is less than the length of said insertion member mountable on the door to be secured against opening without any fixed attachment thereto when inoperative engagement to secure the door, said receiving member being co-axially alignable with said insertion member for receiving therethrough in telescoping relationship said lock receiving portion of said insertion member upon relative axial movement thereof, said receiving member having an uppermost open end through which said lock receiving portion of said insertion member is received, and a lowermost open end through which said lock receiving portion of said insertion member is passed to telescopically join said insertion member to said receiving member;

the first length of said insertion member and the second length of said receiving member being such that said at least one opening of said lock receiving portion will extend outwardly through said lowermost end of said receiving member when said insertion member is inserted into said receiving member when said insertion member retaining portion engages a portion of the rotatable handle and said receiving member is mounted on the door to be secured against opening; and a stop member secured to said receiving member adjacent to said lowermost end thereof for limiting the axial movement of said insertion member relative to said receiving member when said retaining portion engages the portion of the rotatable handle for preventing the rotation thereof in a circular path of movement.

2. The locking device of claim 1 further including a guard member secured to said receiving member in a position adjacent the lowermost end thereof and positioned adjacent the lock receiving portion of said insertion member when said insertion member is inserted through said receiving member for protecting the hasp of a lock received through said opening formed in said lock receiving portion.

3. The locking device of claim 1 wherein a plurality of spaced openings are formed in said lock receiving portion of said insertion member for receiving the hasp of a lock therethrough.

4. The locking device of claim 1 wherein said insertion member, said retaining portion thereof and said receiving member are each formed of square tubing.

5. The locking device of claim 4 wherein said stop member comprises a substantially U-shaped member with the bight portion thereof positioned adjacent the lower portion of said receiving member, and the open end thereof positioned in the direction of engaging movement of said insertion member with said receiving member.

* * * * *